United States Patent [19]

Bloshenko et al.

[11] 4,197,900

[45] Apr. 15, 1980

[54] FURNACE FOR VACUUM ARC MELTING OF HIGHLY REACTIVE METALS

[76] Inventors: Vladimir V. Bloshenko, ulitsa Severnaya, 36, kv. 6, Odintsovo Moskovskoi; Semen M. Beizerov, ulitsa B. Akademicheskaya, 73, korpus 2, kv. 72, Moscow; Alexandr N. Derjugin, ulitsa Severnaya, 54, kv. 121, Odintsovo Moskovskoi; Vladimir A. Ilin, I Mosfilmovsky pereulok, 16, kv. 32, Moscow, all of U.S.S.R.

[21] Appl. No.: 887,228

[22] Filed: Mar. 16, 1978

[51] Int. Cl.[2] ..... B22C 27/02; B22C 27/04

[52] U.S. Cl. ..... 164/147; 164/151; 164/252; 164/348; 165/104 M

[58] Field of Search ..... 164/348, 48, 49, 144, 164/146, 147, 151, 250, 252, 50, 52; 165/104 M; 176/38, 40, 65, 92 R, 92 A, 92 B; 73/49.2, 49.3; 13/9, 32

[56] References Cited

U.S. PATENT DOCUMENTS

| | | | |
|---|---|---|---|
| 2,903,495 | 9/1959 | Dickson et al. | 13/9 |
| 3,159,550 | 12/1964 | Laming | 176/38 |
| 3,291,695 | 12/1966 | Merli | 176/38 |
| 3,713,969 | 1/1973 | Cahill, Jr. | 176/38 |
| 3,900,366 | 8/1975 | Sakaguchi | 176/38 |
| 3,968,653 | 7/1976 | Cachera | 176/38 |
| 3,980,284 | 9/1976 | Shigihara et al. | 164/147 |

FOREIGN PATENT DOCUMENTS

| | | | |
|---|---|---|---|
| 360816 | 11/1931 | United Kingdom | 165/104 M |
| 398492 | 9/1933 | United Kingdom | 165/104 M |

*Primary Examiner*—Robert D. Baldwin
*Assistant Examiner*—K. Y. Lin
*Attorney, Agent, or Firm*—Lackenbach, Lilling & Siegel

[57] ABSTRACT

A furnace including a cooled mould having its bottom sealed with a bottom plate and its top sealed with a cooled vacuum chamber fitted with a cover carrying an electrode holder movably fixed therein. Mounted in the cooling spaces of the furnace units, filled with a liquid-metal cooling agent, are tubular heat exchangers intercommunicating with each other to form a closed circulation circuit filled with a coolant which is chemically neutral to the liquid-metal cooling agent and to water. The cooling spaces of the furnace units are filled with a liquid-metal coolant and communicate with an expansion chamber, as well as with a water heat exchanger through a heat-transfer circuit. Arranged intermediate the mould inner wall and its tubular heat exchanger is a shield made in the form of a hollow cylindrical wall. Fixedly mounted intermediate the shield and the mould outer wall along multiple-thread helical lines are metal strips which form channels at the upper and lower sections thereof, and mounted opposite these channels externally of the mould are electromagnetic superchargers.

5 Claims, 3 Drawing Figures

FURNACE FOR VACUUM ARC MELTING OF HIGHLY REACTIVE METALS

BACKGROUND OF THE INVENTION

1. Field of the Application

The present invention relates to furnaces for vacuum arc melting of highly reactive metals such as titanium and zirconium, and can be used for melting refractory metals such as tungsten and molybdenum.

2. Description of the Prior Art

There is known in the art a furnace for vacuum arc melting of titanium and titanium-based alloys, which comprises a vacuum chamber fitted with a cover having fixed therein an electrode holder spaced above a cooled mould whose bottom is sealed with a detachable bottom plate. The cooling spaces of the mould, bottom plate and that of the electrode holder are filled with a liquid-metal cooling agent (eutectic NaK alloy).

The coolant used in the vacuum chamber is water which circulates in the first cooling circuit. The cooling space of the mould and that of the bottom plate intercommunicate with each other and with an expansion chamber, communicating as well through pipes with a separately arranged air,- or water heat exchanger which comprise the second cooling circuit. The cooling chamber of the electrode holder is brought in communication also by means of pipes with another heat exchanger comprising the third circulation circuit.

In the event of thermal expansion of a liquid-metal coolant the furnace is provided with two expansion vessels filled with a neutral gas such as argon. In addition, the circuit which comprises the mould and bottom plate is provided with a means for cleaning the liquid-metal coolant from oxides.

However, throw-out of liquid alkali metal from the circuit exterior section may possibly to occur during operation due to corrosion-and-erosion attack on the pipeline, caused by the flowing liquid-metal coolant. This type of destruction is very difficult either to predict or control.

Moreover, in case of failure in the eutectic alloy cleaning operation, the pipeline of the cooling circuit system incorporating the water-cooled mould and bottom plate may be blocked by the coolant solid oxides, which may disrupt the furnace operation. In addition, the destruction of pipes in the air-, or water heat exchanger may become the cause of explosion or fire.

The present invention provides an apparatus for vacuum arc skull melting of titanium or its alloys, wherein the exterior section of the liquid-metal circuit is nonexistent.

This apparatus is constructed so that a cooling agent (eutectic NaK alloy) is found only in the cooling space of a crucible, in communication with an expansion chamber. Mounted in said chamber filled with a cooling agent is a water-cooled heat exchanger adapted to produce a signal on leakage of water or eutectic NaK alloy in the event of defect in the heat exchanger pipes.

However, the attempt to eliminate the possibility of contact between water and eutectic NaK alloy by means of special construction elements or else by way of continuous control over the heat exchanger leak-proof sealing in the process of melting results in more complicated furnace construction and fails to provide the furnace operating reliability.

SUMMARY OF THE INVENTION

It is the primary object of the present invention to provide a furnace for vacuum arc melting of highly reactive metals, which is explosion-proof and safer in operation than the known furnaces used for similar purpose.

Another important object of the invention is to provide a furnace which is more reliable in operation.

Still another object of the invention is to provide a furnace which is simple in operation.

These and other objects and features of the invention are accomplished by the provision of a furnace for vacuum arc melting of highly reactive metals, comprising a cooled mould having its bottom sealed with a detachable cooled bottom plate and the top thereof, with a cooled vacuum chamber fitted with a cover having an electrode holder movably fixed therein, the mould, the bottom plate, and the electrode holder cooling space being filled with a liquid-metal cooling agent and communicating with an expansion chamber, said vacuum chamber being provided with a heat-transfer circulation circuit incorporating a water heat exchanger, wherein, according to the invention, there are provided tubular heat exchangers arranged singly in each of the cooling spaces of the mould, of the electrode holder and in that of the vacuum chamber, said cooling spaces communicating with said circulation circuit filled with a cooling agent chemically neutral to the liquid-metal cooling agent and to water, arranged intermediate the inner wall of the cooled mould and its tubular heat exchanger is a shield made in the form of a hollow cylindrical wall, fixedly mounted intermediate the shield and the outer wall of the cooled mould at the lower and upper sections thereof are metal strips arranged along multiple-thread helicoidal lines to thereby form channels, with electromagnetic superchargers being mounted opposite said channels and externally of said mould.

The disposition of tubular heat exchangers in the cooling space of the mould, of the vacuum chamber and in that of the electrode holder makes it possible to simplify the heat-transfer circuit design by reducing the number of fittings, pipes and pumps required for the transfer of liquid NaK alloy. In the event of destruction of the heat exchanger wall, the danger of explosion is nonexistent since NaK alloy is neutral with respect to diphenyl mixture contained in said tubular heat exchangers.

The provision of a hollow shield whose interior is filled with argon enables an alarm signal to be produced in the event of the electric arc burning through in the shield wall.

The shield disposed in the cooling space of the mould form together with the mould outer and inner walls a heat-transfer circuit which provides for excellent conditions of cooling the working (inner) wall of the mould with NaK alloy.

The provision of multi-thread channels at the upper and lower sections of the mould cooling chamber, as well as the provision of electromagnetic superchargers arranged opposite thereto enables the flow of NaK alloy to pass in a desired direction, i.e. along the mould wall, with the cooling thereof being effected at an appreciably high rate. Carrying out the mould cooling by means of an agent chemically neutral to the liquid-metal cooling agent and to water ensures explosion-proof operation of the furnace and, consequently, improves operating reliability of the cooling circulation circuit.

Such furnace construction precludes the penetration of water to the furnace melting chamber or its coming into contact with NaK alloy, thereby rendering the circulation circuit simple in construction and reliable in operation.

It is advisable to secure an electrocontact means serving as a leak indicator on the lower portion of the hollow shield.

This being the case, any damage in the shield resulting in the metal penetration into its interior will actuate the leak indicator to produce an alarm signal.

It is preferable that a pressure pick-up means electrically connected with an alarm means be mounted on the hollow shield.

The provision of the pressure pick-up means mounted on the hollow shield and electrically connected to the alarm means enables an alarm signal to be timely obtained in the event of damage of the hollow shield wall.

BRIEF DESCRIPTION OF THE DRAWINGS

One embodiment of the present invention is illustrated by way of example in the accompanying drawings, in which.

DETAILED DESCRIPTION OF THE PREFERRED EMBODIMENT

Figure 1:
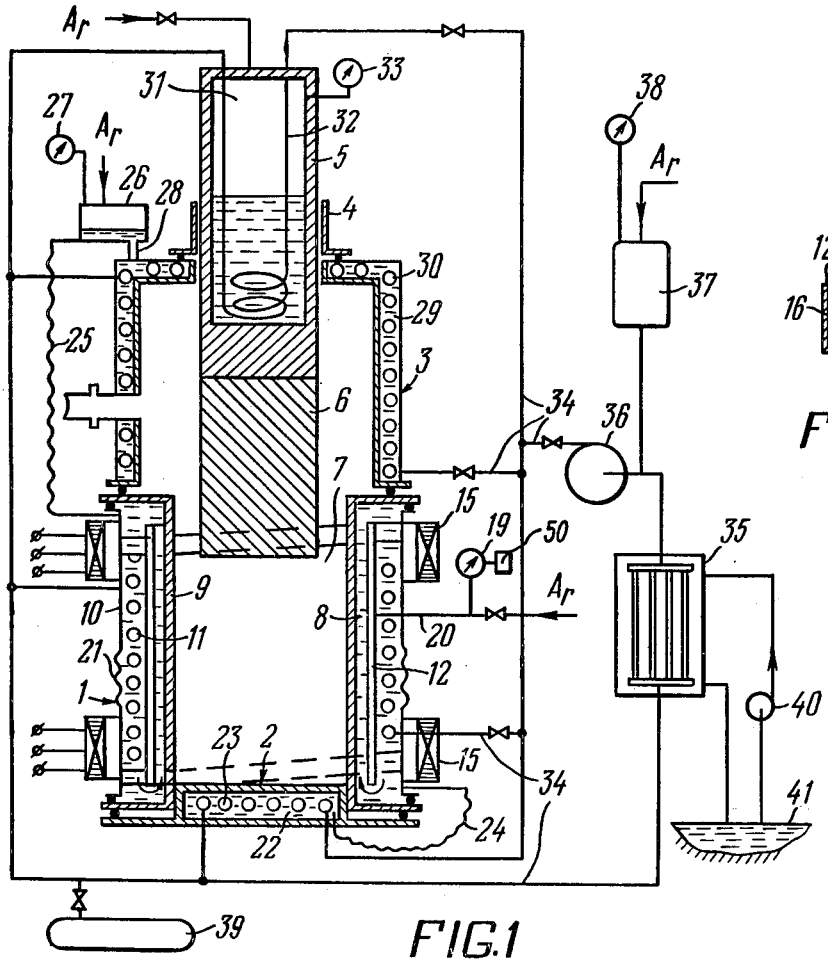
FIG. 1 is a schematic longitudinal cross-section view of a furnace according to the invention.

Referring now to the drawings, and to FIG. 1 in particular, there is shown therein a furnace for vacuum arc melting of highly reactive metals, which comprises a cooled mould 1 whose bottom is sealed with a detachable cooled bottom plate 2 and the top thereof, with a cooled vacuum chamber 3 fitted with a cover 4 having movably fixed therein a cooled electrode holder 5 with a consumable electrode 6.

Figure 2:
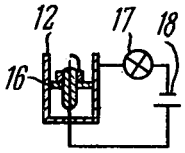
FIG. 2 is an elevation view of the shield lower part which carries a leak indicator and an alarm signal means.
Figure 3:
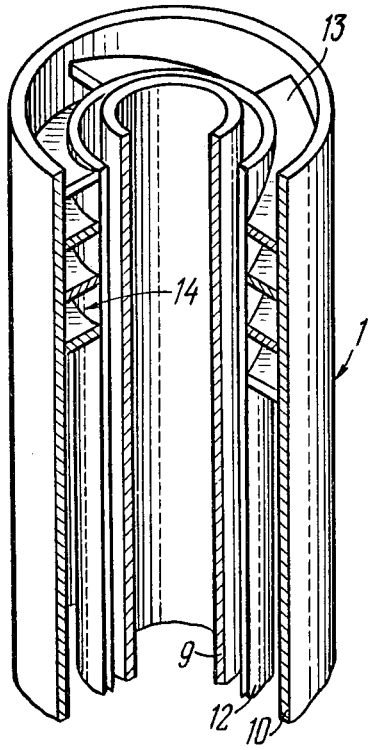
FIG. 3 is an axonometrical view, partially broken out, of the upper section of a mould, which carries a shield and metal strips arranged along the multi-thread helical lines and forming channels.

The cooled mould 1 has a metal melting space 7 and a space 8 for the passage of a cooling agent, the latter being defined by the mould inner wall 9 and its outer wall 10. Arranged in the space 8 is a tubular heat exchanger 11, and arranged intermediate the latter and the mould inner wall 9 is a shield 12 (FIGS. 2 and 3) made in the form of a hollow cylindrical wall. Fixedly mounted intermediate the shield 12 and the outer wall 10 of the cooled mould 1 at its upper and lower sections are metal strips 13 arranged along the multi-thread helical lines and forming channels 14. Arranged opposite said channels externally of the cooled mould 1 are electromagnetic superchargers 15 (FIG. 1) for example, d-c stators which function to create a rotating electromagnetic field inducing the NaK alloy to travel along the helical channels 14 (FIG. 3) and, consequently, over the entire circuit. Mounted at the lower section of the shield 12 (FIG. 2) is a leak indicator 16 which is an electrocontact means (spark plug) electrically connected to a signal lamp 17 and to a power source 18. With liquid metal getting onto the contacts of the leak indicator 16, in the event of leakage of the liquid-metal coolant, electric circuit is closed to result in a signal produced by the lamp 17.

In addition, the shield 12 (FIG. 1) mounts a pressure pick-up means 19 electrically connected to an alarm means 50. The shield 12 forms a closed heat-transfer circuit filled with argon (Ar) under a pressure of up to 1.1 atm. and protects the tubular heat exchanger 11 from the destructive action of electric arc in the event of damage of the inner wall 9 of the cooled mould 1. A flow of argon is passed to the shield 11 through a tube 20, with the pressure pick-up means 19 (manometer) being responsive to pressure below 1.05 atm.

Provided in the middle part of the outer wall 10 of the cooled mould 1 is a compensator means 21 adapted to remove axial deformation load due to occur during thermal expansion of the cooled mould 1 in the process of melting.

The cooling space 8 of the mould 1 is filled with a liquid-metal heat carrier such as eutectic NaK alloy having a minus melting temperature ("12° C.). The tubular heat exchanger 11 located or arranged in the cooling space 8 of the mould 1 is filled with a coolant chemically neutral to NaK alloy and to water. This coolant may be selected from ionic and organosilicon heat-carrying agents such as diphenyl mixture composed of 26.5 wt.% of diphenyl and 73.5 wt.% of diphenyl ether, and having a melting temperature of 12.3° C. The detachable cooled bottom plate 2 has an interior space 22 for the passage of a coolant, wherein is arranged a tubular heat exchanger 23. The cooling space 22 of the bottom plate 2 is brought in communication with the cooling space 8 of the mould 1 by means of a flexible hose 24. In turn, the upper section of the space 8 of the cooled mould 1 communicates through another flexible hose 25 with an expansion chamber 26 provided with a manometer 27.

The manometer 27 is responsive to a drop in pressure below 1.05 atm. in the event of damage of the wall 9 of the cooled mould 1, of the wall of the bottom plate 2 or that of the vacuum chamber 3, said manometer being likewise responsive to a pressure of from 1.6 to 1.7 atm., in case of leackage due to occur in otherwise leak-proof tubular heat exchangers thereof.

The vacuum chamber 3 is connected to the expansion chamber 26 by means of a branch pipe 28.

The cooling space 29 of the vacuum chamber 3 is filled with NaK alloy and accommodates therein a tubular heat exchanger 30.

The cooling space 31 of the electrode holder 5 is filled to two thirds of its volume with a liquid-metal cooling agent, in which is interposed a tubular heat exchanger 32. To control the gas (argon) cushion, there is arranged in the gas-filled space 31 of the electrode holder 5 a contact manometer 33 responsive to a drop in pressure below 1.05 atm.

The tubular heat exchangers 1, 23, 30 and 32 intercommunicate with one another by means of pipes 34 which are introduced into a heat exchanger 35 to provide for water-cooling of the diphenyl mixture circulating in the circuit under the action of a pump 36.

Provided on the circuit means is an expansion vessel 37 filled with nitrogen or argon; gas pressure within said vessel being checked by means of an electrocontact manometer 38 which is responsive to a drop in pressure of 0.2 or 0.3 atm. below a predetermined working pressure. The manometer 38 also functions to produce a signal in the event of failure in the leak-proof circuit through which circulates diphenyl mixture, inclusive of the heat exchangers of the furnace units. The diphenyl mixture is discharged into a receptacle 39 specially provided for this purpose.

Water is delivered to the water heat exchanger 35 by means of a pump 40 from a vessel 41.

The furnace according to the present invention operates in the following manner.

The consumable electrode 6 (FIG. 1) is fixed in the electrode holder 5 and vacuum within the furnace is brought to a preset value, the furnace is then energized to commence the process of melting. As the electrode 6 is consumed and the casting is increased, the arc burning zone is gradually shifting from the bottom upwards. As this happens, the inner wall 9 of the cooled mould 1, the walls of the bottom plate 2, of the vacuum chamber 3 and those of electrode holder 5 absorb the heat radiated by the electric arc and then transfer it to the liquid-metal heat carrier. Thereafter, the heat is transferred through the heat exchangers of the furnace units to the diphenyl mixture circulating in the closed heat-transfer circuit. The diphenyl mixture cooled in the water heat exchanger 35 is then recycled by means of the pump 36 through the pipes 34 to the heat exchangers of the furnace units.

Heat transfer in the electrode holder 5, vacuum chamber 3 and in the bottom plate 2 is effected by virtue of natural convection of NaK alloy in their cooling spaces.

In the mould 1, wherein calorific intensity is maximum and natural convection is insufficient to maintain a prescribed temperature of from 250° to 300° C. at the inner wall 9, the liquid-metal heat carrier is caused to move by means of the electromagnetic superchargers 15. Caused to move by means of said superchargers 15 along the multi-thread helical channels 14, the liquid-metal heat carrier is thus forced to circulate in the circuit.

By this means the heat-transfer process is intensified in the mould cooling space. The electromagnetic superchargers 15, arranged on the end faces of the cooled mould 1, prevent the electromagnetic field from affecting the electricarc process, as well as the ingot crystallization process. During the initial stage of the melting process, when the arc is burning in the lower section of the cooled mould 1, the upper electromagnetic supercharger 15 is in operation. With the melting process going forward above the middle section of the cooled mould 1, the upper supercharger 15 is automatically switched off to actuate the lower one. At the end of the melting process the furnace is deenergized while the cooling system proceeds to operate. In the event of burning through in the inner wall 9 of the cooled mould 1 or in the wall of the bottom plate 2, the contact manometer 27 arranged on the expansion chamber 26 is actuated.

The furnace is thus automatically shut down.

In case of damage in the shield 12, the electrocontact leak indicator 16 is actuated to produce a signal for automatic shut-down of the furnace, and the manometer 19 gives corresponding readings in units of pressure.

The electrocontact manometer 33 produces a signal on the leak in, or damage of, the electrode holder 5.

The furnace according to the present invention when used in combination with electrocontact alarm means eliminates the possibility of explosion in the event of burning through in the wall of the cooled mould 1, thereby providing for safer and more reliable operation.

We claim:

1. A furnace for vacuum arc melting highly reactive metals, comprising: a cooled mould, a detachable cooled bottom plate tightly sealing the bottom of said cooled mould, and a cooled vacuum chamber fitted with a cover tightly sealing the top of said cooled mould; said mould, bottom plate, and vacuum chamber each having outer and inner walls defining cooling spaces filled with a liquid-metal cooling agent and circulating means; and electrode holder containing a cooling space filled with a liquid-metal cooling agent, said electrode holder being movably mounted in the cover of said vacuum chamber; each of the aforesaid cooling spaces having tubular heat exchangers disposed within them, said tubular heat exchangers communicating with a common heat transfer circuit and filled with a liquid cooling agent chemically neutral to the liquid-metal cooling agent and to water; a shield made in the form of a closed hollow cylindrical wall filled with an inert gas, and disposed between the inner wall of said cooled mould and its tubular heat exchanger; an expansion chamber communicating with the cooling spaces of said vacuum chamber, cooled mould and bottom plate; metal strips disposed between the shield and the outer wall of said cooled mould and arranged along a helical line to form channels at the upper and lower sections of the cooling space of said cooled mould; electromagnetic superchargers mounted on the exterior of said cooled mould opposite the channels formed by said metal strips, which serve to circulate the liquid-metal cooling agent along the helical channels and throughout the cooling spaces; electrocontact sensing means secured on the lower portion of said hollow shield to monitor the integrity of the furnace walls.

2. A furnace as claimed in claim 1, wherein a pressure pick-up means is mounted on said hollow shield and electrically connected to an alarm means.

3. A furnace as claimed claim 1, wherein said shield is filled with a gas under pressure.

4. A furnace as claimed in claim 1, wherein the liquid cooling agent circulating within the tubular heat exchanger passes in heat exchange with an external water filled heat exchanger located on the exterior of the furnace.

5. A furnace as claimed in claim 1, wherein the cooling space in the electrode holder is filled to $\frac{2}{3}$ of its volume with the liquid-metal cooling agent.

* * * * *